US007710360B2

(12) United States Patent
Takeuchi et al.

(10) Patent No.: US 7,710,360 B2
(45) Date of Patent: May 4, 2010

(54) PLASMA DISPLAY DEVICE AND PROCESSING METHOD THEREOF

(75) Inventors: Masanori Takeuchi, Bunkyo (JP); Akira Yamamoto, Meguro (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 1024 days.

(21) Appl. No.: 11/386,835

(22) Filed: Mar. 23, 2006

(65) Prior Publication Data

US 2006/0214886 A1 Sep. 28, 2006

(30) Foreign Application Priority Data

Mar. 28, 2005 (JP) ..... 2005-091717

(51) Int. Cl.
*G09G 3/28* (2006.01)

(52) U.S. Cl. ..... 345/63; 345/692; 315/169.2

(58) Field of Classification Search ..... 345/63, 345/692; 315/169.2
See application file for complete search history.

(56) References Cited

U.S. PATENT DOCUMENTS 6,965,358 B1 * 11/2005 Kasahara et al. ..... 345/63
7,209,152 B2 * 4/2007 Chiaki et al. ..... 345/692
2001/0045923 A1 * 11/2001 Otobe et al. ..... 345/63
2003/0173903 A1 * 9/2003 Takeuchi et al. ..... 315/169.2
2004/0257310 A1 * 12/2004 Yu et al. ..... 345/63
2006/0145953 A1 * 7/2006 Takeuchi ..... 345/63

FOREIGN PATENT DOCUMENTS

JP 8-146914 6/1996
JP 2000-276100 10/2000

OTHER PUBLICATIONS

Korean Patent Office Action, mailed Jun. 28, 2007 and issued in corresponding Korean Patent Application No. 10-2006-0026757.
Patent Abstracts of Japan, Japanese Patent Publication No. 10-153983; Published Jun. 9, 1998; Inventor: Kawahara ISAO; Abstract only.

* cited by examiner

*Primary Examiner*—Amare Mengistu
*Assistant Examiner*—Premal Patel
(74) *Attorney, Agent, or Firm*—Staas & Halsey LLP

(57) ABSTRACT

There is provided a plasma display device including: a nonlinear conversion circuit which nonlinearly converts a first image signal to a second image signal and expresses the second image signal by a real part and an error part to avoid use of a specific subfield lighting pattern; an error diffusion circuit which, when the error part of the second image signal is not zero, spatially or temporally diffuses the error part; and a subfield pattern conversion circuit which, when a lighting pattern of subfields is selected based on the error-diffused second image signal, selects another subfield lighting pattern without using the specific subfield lighting pattern.

9 Claims, 11 Drawing Sheets

FIG. 6

| S3 | SF4 | SF3 | SF2 | SF1 | S2 |
|---|---|---|---|---|---|
| | 12 | 6 | 3 | 1 | |
| 0 | 0 | 0 | 0 | 0 | 0 |
| 1 | 0 | 0 | 0 | 1 | 1 |
| 2 | 0 | 0 | 1 | 0 | 3 |
| 3 | 0 | 0 | 1 | 1 | 4 |
| 4 | 0 | 1 | 0 | 0 | 6 |
| | | | | | |
| 15 | 1 | 1 | 1 | 1 | 22 |

FIG. 7

| S2 | S3 | SA | SB |
|---|---|---|---|
| 0 | 0 | 0 | 0 |
| 1 | 1 | 1 | 0 |
| 2 | 1.5 | 1 | 0.5 |
| 3 | 2 | 2 | 0 |
| 4 | 3 | 3 | 0 |
| 5 | 3.5 | 3 | 0.5 |
| 6 | 4 | 4 | 0 |
| | | | |
| 22 | 15 | 15 | 0 |

| | SF6 | SF5 | SF4 | SF3 | SF2 | SF1 |
|---|---|---|---|---|---|---|
| | 32 | 16 | 8 | 4 | 2 | 1 |
| 27 | 0 | 1 | 1 | 0 | 1 | 1 |
| 28 | 0 | 1 | 1 | 1 | 0 | 0 |
| 29 | 0 | 1 | 1 | 1 | 0 | 1 |
| 30 | 0 | 1 | 1 | 1 | 1 | 0 |
| 31 | 0 | 1 | 1 | 1 | 1 | 1 |
| 32 | 1 | 0 | 0 | 0 | 0 | 0 |
| 33 | 1 | 0 | 0 | 0 | 0 | 1 |
| 34 | 1 | 0 | 0 | 0 | 1 | 0 |
| 35 | 1 | 0 | 0 | 0 | 1 | 1 |
| 36 | 1 | 0 | 0 | 1 | 0 | 0 |
| 37 | 1 | 0 | 0 | 1 | 0 | 1 |
| 38 | 1 | 0 | 0 | 1 | 1 | 0 |
| 39 | 1 | 0 | 0 | 1 | 1 | 1 |
| 40 | 1 | 0 | 1 | 0 | 0 | 0 |

| | SF6 | SF5 | SF4 | SF3 | SF2 | SF1 |
|---|---|---|---|---|---|---|
| | 32 | 16 | 8 | 4 | 2 | 1 |
| 27 | 0 | 1 | 1 | 0 | 1 | 1 |
| 28 | 0 | 1 | 1 | 1 | 0 | 0 |
| 29 | 0 | 1 | 1 | 1 | 0 | 1 |
| 30 | 0 | 1 | 1 | 1 | 1 | 0 |
| 31 | 0 | 1 | 1 | 1 | 1 | 1 |
| 32 | | | | | | |
| 33 | | | | | | |
| 34 | | | | | | |
| 35 | | | | | | |
| 36 | 1 | 0 | 0 | 1 | 0 | 0 |
| 37 | 1 | 0 | 0 | 1 | 0 | 1 |
| 38 | 1 | 0 | 0 | 1 | 1 | 0 |
| 39 | 1 | 0 | 0 | 1 | 1 | 1 |
| 40 | 1 | 0 | 1 | 0 | 0 | 0 |

| S3 | SF4 | SF3 | SF2 | SF1 | S2 |
|---|---|---|---|---|---|
| | 12 | 6 | 3 | 1 | |
| 0 | 0 | 0 | 0 | 0 | 0 |
| 1 | 0 | 0 | 0 | 1 | 1 |
| 2 | 0 | 0 | 1 | 0 | 3 |
| | | | | | |
| 3 | 0 | 1 | 0 | 0 | 6 |
| | | | | | |
| | | | | | |
| 14 | 1 | 1 | 1 | 1 | 22 |

| S2 | S3 | SA | SB |
|---|---|---|---|
| 0 | 0 | 0 | 0 |
| 1 | 1 | 1 | 0 |
| 2 | 1.5 | 1 | 0.5 |
| 3 | 2 | 2 | 0 |
| 4 | 2.33... | 2 | 0.33... |
| 5 | 2.66... | 2 | 0.66... |
| 6 | 3 | 3 | 0 |
| | | | |
| 22 | 14 | 14 | 0 |

PLASMA DISPLAY DEVICE AND PROCESSING METHOD THEREOF

CROSS-REFERENCE TO RELATED APPLICATIONS

This application is based upon and claims the benefit of priority from the prior Japanese Patent Application No. 2005-091717, filed on Mar. 28, 2005, the entire contents of which are incorporated herein by reference.

BACKGROUND OF THE INVENTION

1. Field of the Invention

The present invention relates to a plasma display device and a processing method thereof.

2. Description of the Related Art

Improvement in the image quality of a plasma display device has been advancing, and especially for higher luminance and stable light emission, the cycle or width of a sustain pulse has been sometimes changed. Such sustain pulse control raises a possibility that the light emission luminance per sustain pulse of each subfield differs. Since the gradation of the plasma display device is expressed by a combination of plural subfields, gradation linearity is broken especially in a low gradation part.

Moreover, in Patent Document 1 described later, an image display device including plural nonlinear conversion units which receive an input image signal as a common input, a selection unit which selects one of outputs of the plural nonlinear conversion units, a selection control unit which controls the selection unit, and a display unit which receives an output of the selection unit as an input is described.

(Patent Document 1)

Japanese Patent No. 3518205

If the gradation linearity is broken, the luminance ratio among respective pixels of red, green, and blue deviates from an ideal value, which causes coloring and irregular color, leading to a loss in image quality. In particular, the linearity tends to be broken in the low gradation part. Furthermore, the problem specific to the plasma display device is that a dynamic false contour may occur, which causes a reduction in image quality.

SUMMARY OF THE INVENTION

An object of the present invention is to provide a plasma display device capable of maintaining gradation linearity and/or preventing a dynamic false contour from occurring, and a processing method thereof.

According to one aspect of the present invention, there is provided a plasma display device which comprises: a display unit which expresses a gradation of an image by selecting a pattern of subfields to light up out of plural subfields composing one field, each of the subfields having a weighted number of sustain pulses; a nonlinear conversion circuit which nonlinearly converts a first image signal to a second image signal and expresses the second image signal by a real part and an error part to avoid use of a specific subfield lighting pattern; an error diffusion circuit which, when the error part of the second image signal is not zero, spatially or temporally diffuses the error part; and a subfield pattern conversion circuit which, when a lighting pattern of the subfields is selected based on the error-diffused second image signal, selects another subfield lighting pattern without using the specific subfield lighting pattern.

BRIEF DESCRIPTION OF THE DRAWINGS

FIG. 6 is a table showing an example of gradation values when one field is composed of four subfields;

FIG. 7 is a table showing an example of a nonlinear conversion performed by the nonlinear gain circuit;

DETAILED DESCRIPTION OF THE PREFERRED EMBODIMENTS

First Embodiment

Figure 1:
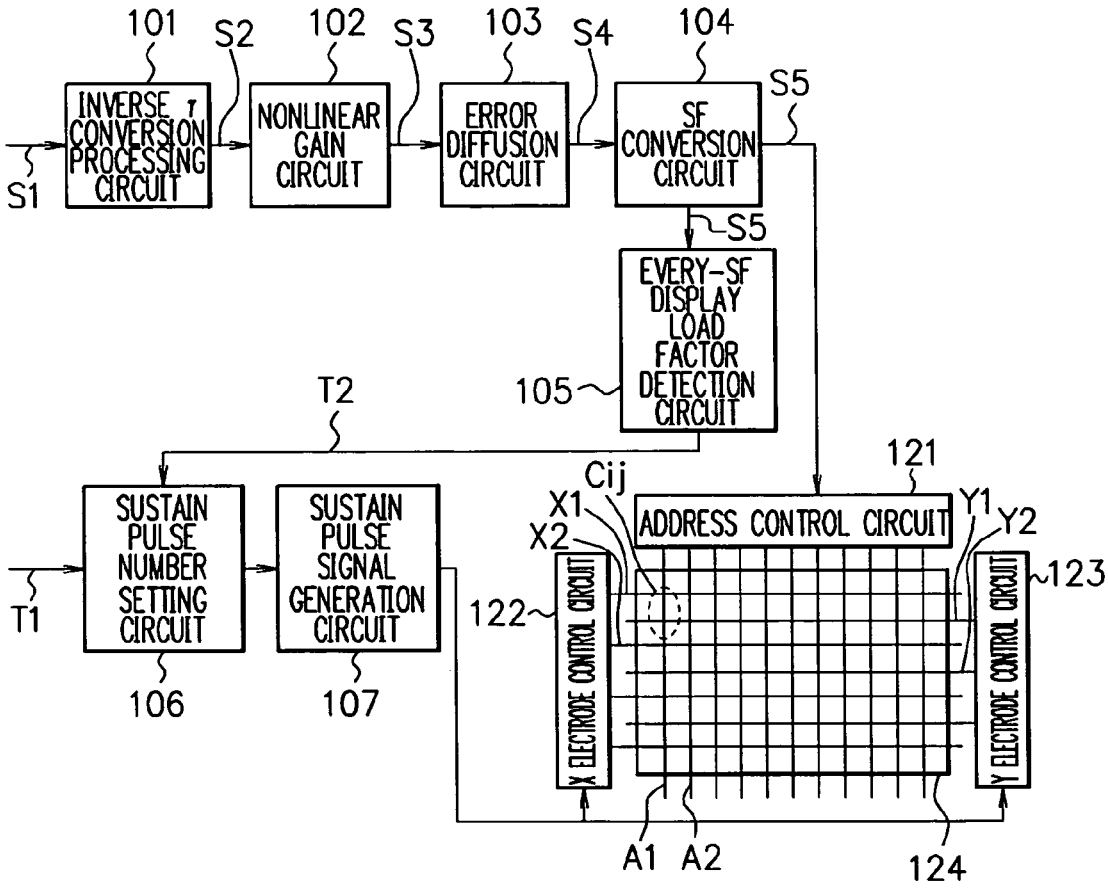
FIG. 1 is a diagram showing a configuration example of a plasma display device according to a first embodiment of the present invention.

FIG. 1 is a diagram showing a configuration example of a plasma display device according to a first embodiment of the present invention. An address control circuit 121 supplies a predetermined voltage to address electrodes A1, A2, . . . . Hereinafter, the address electrodes A1, A2, . . . are individually or generically called an address electrode Aj, the j meaning a subscript.

An X electrode control circuit 122 supplies a predetermined voltage to X electrodes X1, X2, . . . . Hereinafter, the X electrodes X1, X2, . . . are individually or generically called an X electrode Xi, the i meaning a subscript.

A Y electrode control circuit 123 supplies a predetermined voltage to Y electrodes Y1, Y2, . . . . Hereinafter, the Y electrodes Y1, Y2, . . . are individually or generically called a Y electrode Yi, the i meaning a subscript.

In a plasma display panel (display unit) 124, the Y electrodes Yi and the X electrodes Xi form rows extending in parallel in a horizontal direction, and the address electrodes Aj form columns extending in a vertical direction. The Y electrodes Yi and the X electrodes Xi are arranged alternately in the vertical direction.

The Y electrodes Yi and the address electrodes Aj form a two-dimensional matrix with i rows and j columns. A display cell Cij is formed by an intersection point of the Y electrode Yi and the address electrode Aj and the X electrode Xi correspondingly adjacent thereto. This display cell Cij corresponds to a pixel, and the panel 124 can display a two-dimensional image.

Figure 2A:
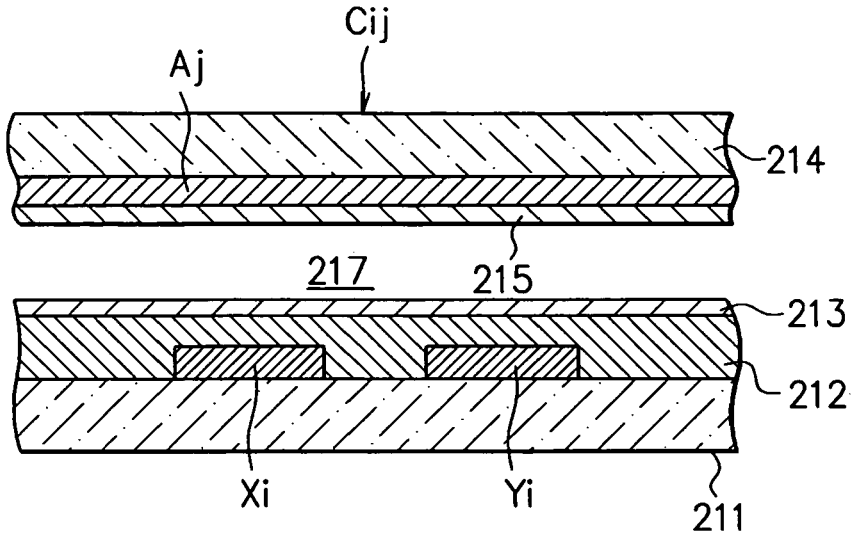
FIG. 2A to FIG. 2C are views each showing a configuration example of a section of a display cell.

FIG. 2A is a view showing a configuration example of a section of the display cell Cij in FIG. 1. The X electrode Xi and the Y electrode Yi are formed on a front glass substrate 211. Thereon, a dielectric layer 212 for insulating them from a discharge space 217 is deposited, and further thereon, a MgO (magnesium oxide) protective film 213 is deposited.

Meanwhile, the address electrode Aj is formed on a rear glass substrate 214 placed opposite the front glass substrate 211, thereon a dielectric layer 215 is deposited, and further thereon a phosphor is deposited. A Ne+Xe Penning gas or the like is sealed into the discharge space 217 between the MgO protective film 213 and the dielectric layer 215.

Figure 2B:
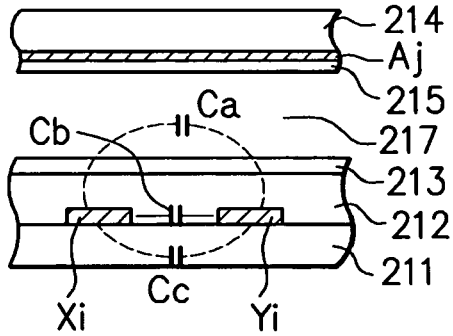

FIG. 2B is a view for explaining a panel capacitance Cp of an AC drive type plasma display. A capacitance Ca is a capacitance of the discharge space 217 between the X electrode Xi and the Y electrode Yi. A capacitance Cb is a capacitance of the dielectric layer 212 between the X electrode Xi and the Y electrode Yi. A capacitance Cc is a capacitance of the front glass substrate 211 between the X electrode Xi and the Y electrode Yi. The panel capacitance Cp between the electrodes Xi and Yi is determined by the sum of these capacitances Ca, Cb, and Cc.

Figure 2C:
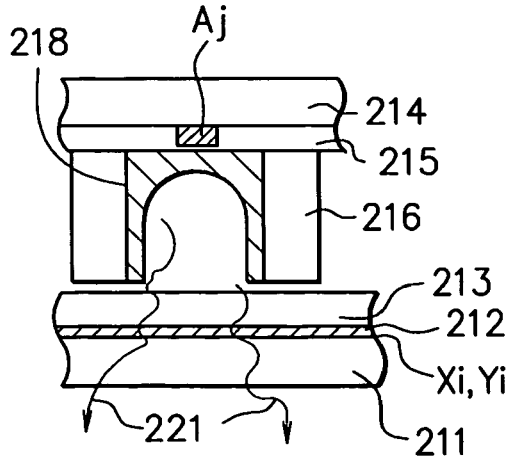

FIG. 2C is a view for explaining a light emission of the AC drive type plasma display. Phosphors 218 of red, blue, and green are arranged and applied in stripes of respective colors on inner surfaces of ribs 216, and the phosphors 18 are exited by an electric discharge between the X electrode Xi and the Y electrode Yi to generate light 221.

Figure 3:
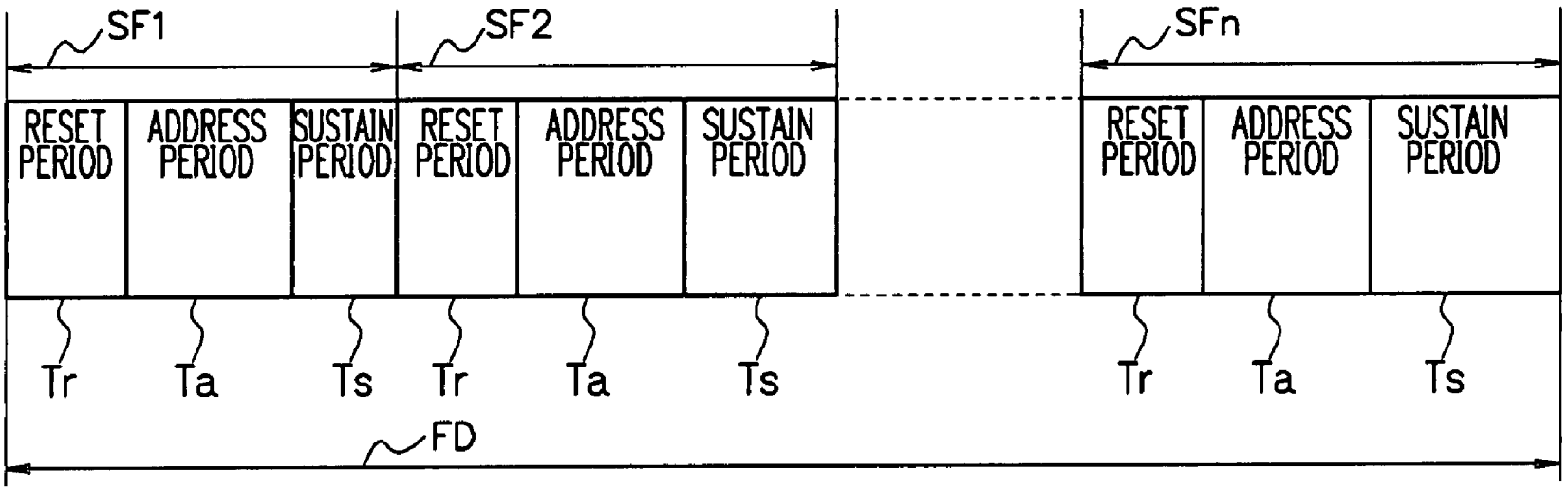
FIG. 3 is a diagram showing a configuration example of one field of an image.

FIG. 3 is a diagram showing a configuration example of one field FD of an image. The image is formed at, for example, 60 fields per second. The one field FD is formed by a first subfield SF1, a second subfield SF2, . . . , and an n-th subfield SFn. This n is, for example, 10 and corresponds to the number of gradation bits. Hereinafter, the subfields SF1, SF2, and so on are individually or generically called as a subfield SF.

Each subfield SF is composed of a reset period Tr, an address period Ta, and a sustain (sustain discharge) period Ts. In the reset period Tr, display cells are initialized. In the address period Ta, light emission or non-light emission of each display cell can be selected by an address discharge between the address electrode Aj and the Y electrode Yi. In the sustain period Ts, a sustain discharge is performed between the X electrode Xi and the Y electrode Yi of the selected display cell to emit light. The number of light emissions (duration of the sustain period Ts) corresponding to the number of sustain pulses between the X electrode Xi and the Y electrode Yi differs according to each subfield SF. This can determine a gradation value.

FIG. 6 is a table showing an example of gradation values when the one field FD is composed of four subfields SF1 to SF4 to simplify the explanation. For example, the weight of the subfield SF1 is 1, the weight of the subfield SF2 is 3, the weight of the subfield SF3 is 6, and the weight of the subfield F4 is 12. The ratio of these weights correspond to the ratio of the numbers of sustain pulses. A subfield lighting pattern is shown by (SF4, SF3, SF2, SF1), "1" indicates "lighting", and "0" indicates "non-lighting". A gradation value S2 becomes a total value of the weights of the subfields selected to light up. When the subfield lighting pattern is (0, 0, 0, 1), the gradation value S2 becomes 1. When the subfield lighting pattern is (0, 0, 1, 0), the gradation value S2 becomes 3. When the subfield lighting pattern is (0, 0, 1, 1,), the gradation value S2 becomes 4.

The configuration in FIG. 1 will be described. The panel 124 can express the gradation of the image by selecting a pattern of subfields to light up out of plural subfields composing one field, each of the subfields having a weighted number of sustain pulses.

An inverse gamma conversion processing circuit 101 receives a digital format image signal S1, applies an inverse gamma conversion to it, and outputs an image signal S2 with a linear characteristic.

A nonlinear gain (conversion) circuit 102 nonlinearly converts the image signal S2 to an image signal S3 and expresses the image signal S3 by an integral part (real part) and a decimal part (error part) to avoid use of a specific subfield lighting pattern.

An error diffusion circuit 103 receives the input signal S3, and when the decimal part of the image signal S3 is not zero, the error diffusion circuit 103 diffuses this decimal part spatially or temporally and outputs an image signal S4 to perform a gradation expression in a false manner.

When a subfield lighting pattern is selected based on the error-diffused image signal S4, a subfield conversion circuit 104 selects another subfield lighting pattern without using the above-described specific subfield lighting pattern and generates a subfield lighting pattern signal S5. The address control circuit 121 generates a voltage for the address electrode Aj to select a subfield to be lit up regarding each pixel according to the subfield lighting pattern signal S5.

An every-subfield display load factor detection circuit 105 calculates a display load factor T2 for every subfield based on the subfield lighting pattern signal S5. The display load factor is detected based on the number of light-emitting pixels and the gradation values of the light-emitting pixels. For example, when all pixels of the image are displayed at a maximum gradation value, the display load factor is 100%. When all pixels of the image are displayed at a half of the maximum gradation value, the display load factor is 50%. Also when only pixels of one half (50%) of the image are displayed at the maximum gradation value, the display load factor is 50%.

A sustain pulse number setting circuit 106 receives a timing signal T1 and the display load factor T2, and calculates the total number of sustain pulses in one field by constant power control according to the display load factor of one field. In the constant power control, the total number of sustain pulses in one field is controlled according to the display load factor of one field. Irrespective of the display load factor, when the total number of sustain pulses in one field is fixed, the power increases with an increase in the display load factor, resulting in increased heat quantity. Hence, the sustain pulse number setting circuit 106 performs constant power control by making a calculation so as to decrease the total number of sustain pulses in one field when the display load factor of one field is large.

A sustain pulse signal generation circuit 107 divides the total number of sustain pulses so as to correspond to the weight ratio among the respective subfields and generates a sustain pulse signal for display. The X electrode control circuit 122 and the Y electrode control circuit 123 generate voltages for the X electrode Xi and the Y electrode Yi according to the sustain pulse signal. The display cell selected by the address electrode Aj is sustain-discharged between the X electrode Xi and the Y electrode Yi and emits light.

Figure 4:
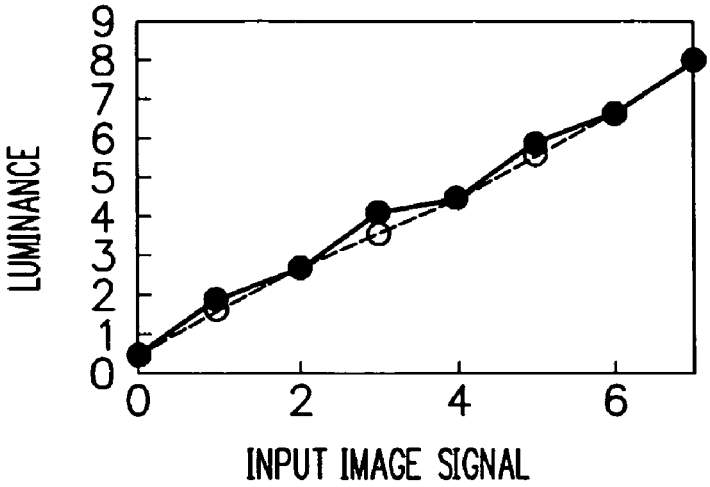
FIG. 4 is a graph showing an example in which a nonlinear gain circuit converts a nonlinear gradation region of a low gradation part.

FIG. 4 is a graph showing an example in which the nonlinear gain circuit 102 in FIG. 1 converts a nonlinear gradation region of a low gradation part. The horizontal axis represents the input image signal S2, and the vertical axis represents luminance. When the luminance ratio among respective subfields is not exactly an integer ratio, the gradation expressed by a combination of the respective subfields does not have a linear characteristic. FIG. 4 shows an example when the subfields SF1 and SF2 are brighter than the other subfields, and a solid line represented by black circles shows luminance when lighting is performed by simply combining the respective subfields. When the value of the input image signal S2 is "1, 3, 5", a nonlinear portion becomes conspicuous. A broken line represented by white circles shows the output image signal S3 of the nonlinear gain circuit 102, and when the input image signal S2 is "0, 2, 4, 6, 7", it is outputted as it is as the image signal S3. When the input image signal S2 is "1", the input signal S3 is generated by allocating the values "0" and "2" of the input signal S2 in a ratio whose sum is 1. When the input image signal S2 is "3", the input signal S3 is generated by allocating the values "2" and "4" of the input image signal S2 in a ratio whose sum is 1. When the input image signal S2 is "5", the input signal S3 is generated by allocating the values "4" and "6" of the input image signal S2 in a ratio whose sum is 1.

Figure 5:
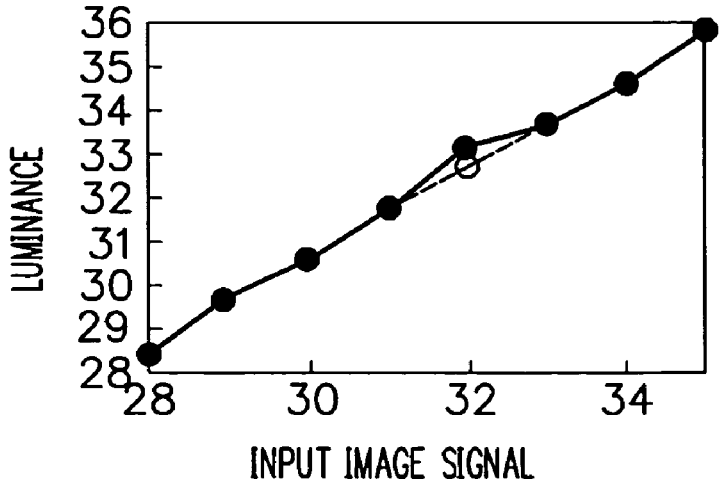
FIG. 5 is a graph showing an example in which the nonlinear gain circuit converts a nonlinear gradation region of a middle to high gradation part.

FIG. 5 is a graph showing an example in which the nonlinear gain circuit 102 in FIG. 1 converts a nonlinear gradation region of a middle to high gradation part. The horizontal axis represents the input image signal S2, and the vertical axis represents luminance. The example in FIG. 5 shows a case where when the input image signal S2 is "32", the luminance is higher compared with the luminance of the image signal S2 prior and subsequent thereto. In this case, the image signal S3 is generated by allocating the prior and subsequent gradation values "31" and "32" which maintain linearity in a ratio whose sum is 1 without using the subfield lighting pattern of the image signal S2 of "32". Consequently, gradation linearity can be maintained.

Improvement in the image quality of the plasma display device has been advancing, and especially for higher luminance and stable light emission, the cycle or width of the sustain pulse has been sometimes changed according to the display load factor or the like. Such sustain pulse control raises a possibility that the light emission luminance per sustain pulse in each subfield differs. Since the gradation of the plasma display device is expressed by a combination of plural subfields, the gradation linearity is broken especially in the low gradation part. In other words, the luminance ratio among respective pixels of red, green, and blue deviates from an ideal value, which causes coloring and irregular color, leading to a loss in image quality. In particular, the linearity tends to be broken in the low gradation part.

In this embodiment, without using one or more subfield lighting patterns resulting in nonlinear gradation out of continuous plural subfield lighting patterns, only the other subfield lighting patterns are used, and the gradation expressed by the unused subfield lighting pattern is expressed by error diffusion using the other subfield lighting patterns. This can realize gradation linearity.

FIG. 6 shows an example of the relation between the image signals S2 and S3. If four subfields SF1 to SF4 are used, 16 subfield lighting patterns exist. For example, the weight of the subfield SF1 is 1, the weight of the subfield SF2 is 3, the weight of the subfield SF3 is 6, and the weight of the subfield SF4 is 12. The gradation value S2 is the total value of weights of subfields which are selected to light up. Gradation values of the image signal S3 are numbered sequentially with respect to the subfield lighting patterns in the order of luminance.

When the image signal S3 is "0", the subfield lighting pattern is (0, 0, 0, 0,), and the image signal S2 becomes 0. When the image signal S3 is "1", the subfield lighting pattern is (0, 0, 0, 1), and the image signal S2 becomes 1. When the image signal S3 is "2", the subfield lighting pattern is (0, 0, 1, 0), and the image signal S2 becomes 3. When the image signal S3 is "3", the subfield lighting pattern is (0, 0, 1, 1), and the image signal S2 becomes 4. When the image signal S3 is "4", the subfield lighting pattern is (0, 1, 0, 0), and the image signal S2 becomes 6. When the image signal S3 is "15", the subfield lighting pattern is (1, 1, 1, 1), and the image signal S2 becomes 22.

In this case, values "2, 5", and so on of the image signal S2 do not exist. To make these values "2, 5" and so on exist, it is recommended to set the weight of the subfield SF1 to 1, the weight of the subfield SF2 to 2, the weight of the subfield SF3 to 4, and the weight of the subfield SF4 to 8. However, in this case, the image signal S2 can express only 16 gradations which can express values from 0 to 15. By assigning such weights as shown in FIG. 6, the image signal S2 can realize 23 gradations which can express values from 0 to 22, and enlarge the dynamic range.

FIG. 7 is a table showing an example of a nonlinear conversion performed by the nonlinear gain circuit 102. The nonlinear gain circuit 102 receives the image signal S2 and outputs the image signal S3. For example, the image signals S2 and S5 are 23-gradation signals, and the image signals S3 and S4 are 16-gradation signals.

The image signal S2 can take values from 0 to 22. The 16 subfield lighting patterns existing in the table in FIG. 6 maintain the relation between the image signals S2 and S3. Patterns which do not exist in the table in FIG. 6 are found by interpolation. For example, when the image signal S2 is "2", the image signal S3 is halfway between "1" and "2", so that it is set to "1.5". Similarly, when the image signal S2 is 5, the image signal S3 becomes "3.5". The image signal S3 is composed of an integral part SA and a decimal part SB.

Figures 8, 9:
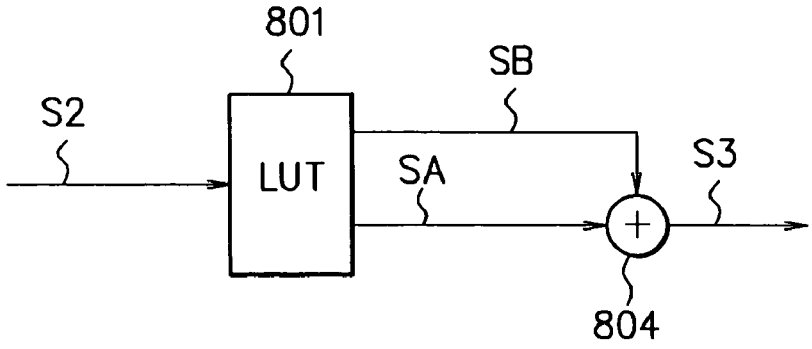
FIG. 8 is a diagram showing a configuration example of the nonlinear gain circuit.
FIG. 9 is a table showing subfield lighting patterns using six subfields according to a second embodiment of the present invention.

FIG. 8 is a diagram showing a configuration example of the nonlinear gain circuit 102. A lookup table 801 stores the table shown in FIG. 7, receives the input image signal S2, and outputs the integral part SA and the decimal part SB corresponding thereto. An adder 804 adds the integral part SA and the decimal part SB, and outputs the image signal S3.

Now, a description will be given with a case where in FIG. 6, for example, since the subfield lighting pattern (0, 0, 1, 1) when the image signal S3 is "3" results in nonlinear gradation, it is not used as an example.

Figures 12, 13:
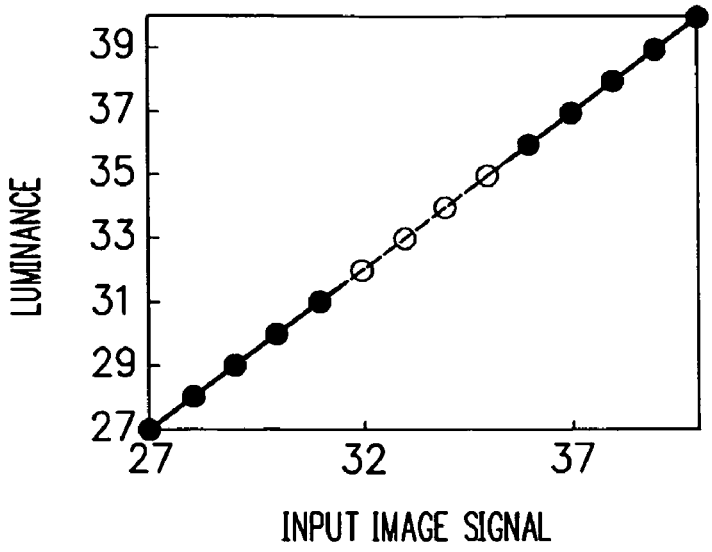
FIG. 12 is a graph showing the relation between the input image signal and luminance in the subfield lighting patterns shown in FIG. 11.
FIG. 13 is a table showing 15 usable subfield lighting patterns other than a subfield lighting pattern (0, 0, 1, 1)

FIG. 13 is a table showing 15 usable subfield lighting patterns other than the subfield lighting pattern (0, 0, 1, 1). The subfield lighting patterns in FIG. 13 are obtained by deleting the unused subfield lighting pattern (0, 0, 1, 1) from the subfield lighting patterns in FIG. 6 and renumbering the values of the image signal S3.

Figures 14, 15:
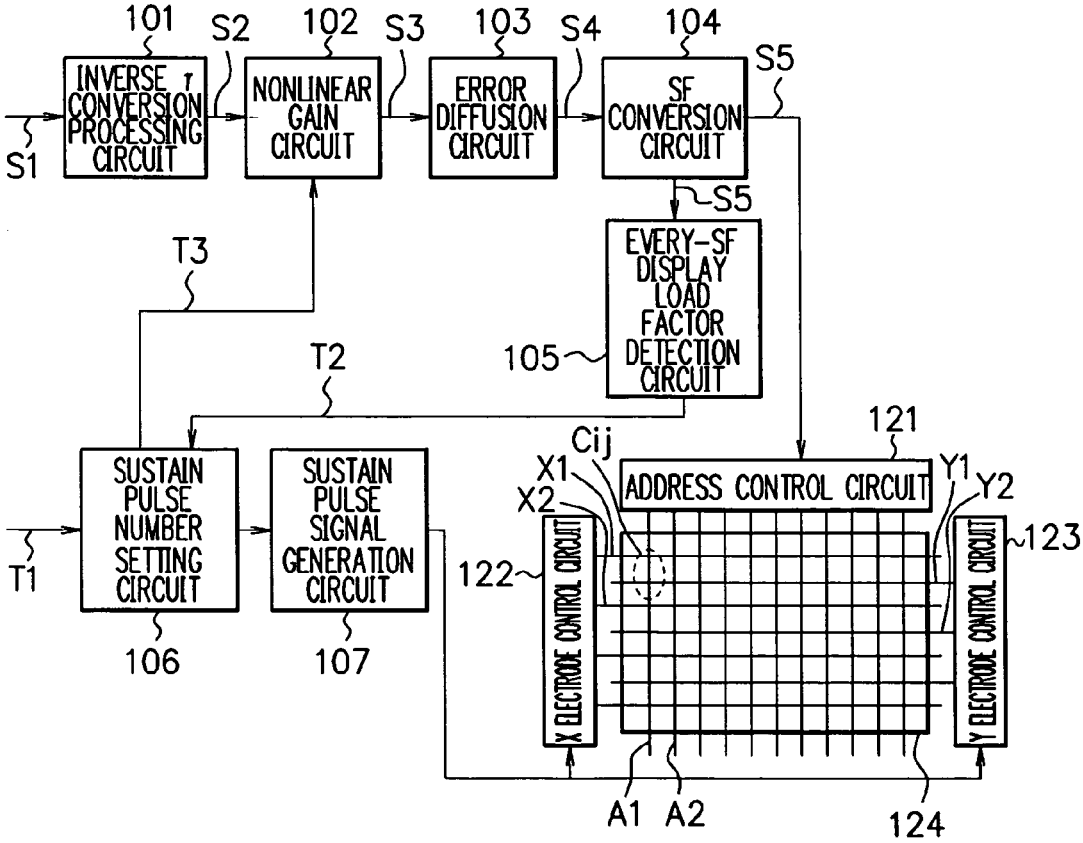
FIG. 14 is a table showing an example of a nonlinear conversion performed by the nonlinear gain circuit based on the subfield lighting patterns in FIG. 13.
FIG. 15 is a diagram showing a configuration example of a plasma display device according to a fourth embodiment of the present invention.

FIG. 14 is a table showing an example of a nonlinear conversion performed by the nonlinear gain circuit 102 based on the subfield lighting patterns in FIG. 13. The nonlinear gain circuit 102 receives the image signal S2 and outputs the image signal S3.

The image signal S2 can take values from 0 to 22. The 15 subfield lighting patterns existing in the table in FIG. 13 maintain the relation between the image signals S2 and S3. Patterns which do not exist in the table in FIG. 13 are found by interpolation in the same manner as in FIG. 7. For example, values "4" and "5" of the image signal S2 do not exist. These values are interpolated using values "2" and "3" of the image signal S3. For the value "4" of the image signal S2, the image signal S3 is $2\times(2/3)+3\times(1/3)=2.33\ldots$, the integral part SA is 2, and the decimal part SB is 0.33 . . . . For the value "5" of the image signal S2, the image signal S3 is $2\times(1/3)+3\times(2/3)=2.66\ldots$, the integral part SA is 2, and the decimal part SB is 0.66 . . . .

The error diffusion circuit 103 in FIG. 1 receives the image signal S3 from the nonlinear gain circuit 102. The image signal S3 has the integral part SA and the decimal part SB. The error diffusion circuit 103 spatially or temporally diffuses the integral part SB as an error.

First, the case of a spatial error diffusion will be described. The decimal part SB of a target pixel is propagated as an error to its neighboring pixels. The target pixel adds its own decimal part SB and errors propagated from its neighboring pixels as a weight, adds a result of the addition and its own integral part SA, and generates an integral part of an additional value thereof as the image signal S4. A decimal part of the additional value is propagated as an error of its own pixel to its neighboring pixels. By spatially diffusing the error as just described, the image signal S3 composed of the integral part SA and the decimal part SB can be expressed.

Next, the case of a temporal error diffusion will be described. In this case, the error is diffused to a field prior to and subsequent to a target field. In actuality, it is preferable to diffuse the error to the subsequent field. In other respects, it is the same as the spatial error diffusion.

By performing the error diffusion as described above, 23 gradations can be expressed by using the 15 subfield lighting patterns shown in FIG. 13. In the unused specific subfield lighting pattern, the luminance value deviates so as to be larger with respect to the value of the image signal corresponding thereto as shown in FIG. 4 and FIG. 5, and hence when the specific subfield lighting pattern is used, the luminance becomes nonlinear with respect to the image signal S2. In this embodiment, the subfield lighting pattern with a nonlinear characteristic is not used, the gradation expression with a linear characteristic can be realized.

Second Embodiment

A second embodiment of the present invention will be described. Points of this embodiment different from the first embodiment will be described.

Figures 10, 11:
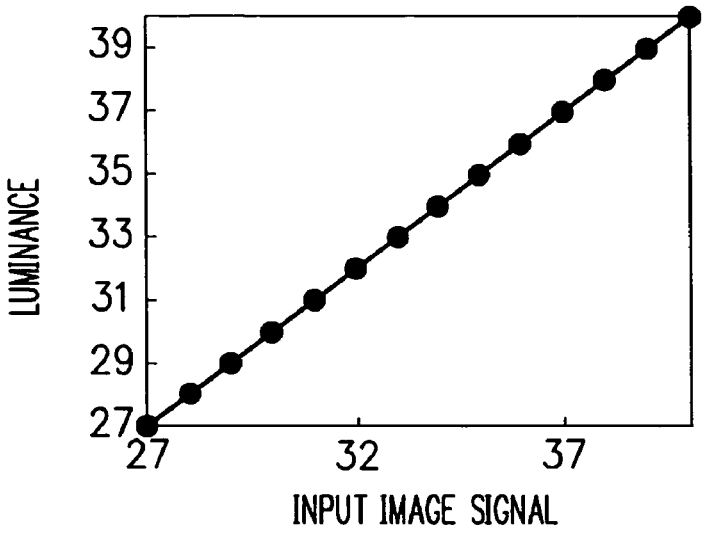
FIG. 10 is a graph showing the relation between an input image signal and luminance in the subfield lighting patterns in FIG. 8.
FIG. 11 is a table showing subfield lighting patterns which are usable for preventing a dynamic false contour from occurring.

FIG. 9 is a table showing subfield lighting patterns using six subfields SF1 to SF6, and FIG. 10 is a graph showing the relation between the input image signal S2 and luminance. As an example, the input image signal S2 shows values from 27 to 40, the luminance shows values from 27 to 40, and both have linear characteristics. The weight of the subfield SF1 is 1, the weight of the subfield SF2 is 2, the weight of the subfield SF3 is 4, the weight of the subfield SF4 is 8, the weight of the subfield SF5 is 16, and the weight of the subfield SF6 is 32. However, if these subfield lighting patterns are used, a dynamic false contour occurs.

Next, the dynamic false contour will be described. The specific subfield lighting pattern together with the subfield patterns of pixels adjacent thereto appears, to human eyes, as if a false contour of a large gradation value exists in the moving image. This phenomenon is the dynamic false contour. To prevent this dynamic false contour, the error diffusion processing is performed by replacing the specific subfield lighting pattern with another subfield lighting pattern to avoid use of the specific subfield lighting pattern in the same manner as in the first embodiment.

For example, if the subfield lighting pattern (0, 1, 1, 1, 1, 1) is displayed in some pixel and the subfield lighting pattern (1, 0, 0, 0, 0, 0) is displayed in its adjacent pixel, the difference in graduation value between both the pixels is 1. However, in the moving image, both the pixels are combined and appear to be one pixel with a high gradation value, and appear as if a contour exist there. This is the dynamic false contour. Such a dynamic false contour tends to occur in a subfield lighting pattern having gradation values prior to and subsequent to a gradation value at which a subfield with a larger weight first lights up when subfield lighting patterns are arranged in order of gradation value. In other words, it tends to occur in a pattern in which the temporal deviation of the temporal center of gravity of light emission between subfield lighting patterns with adjacent luminance values becomes larger. In one field, for example, six subfields SF1 to SF6 are arranged in order of time. For example, the subfields SF1 to SF6 light up in this order. At gradation values from 27 to 31 of the input image signal S2, the temporal center of gravity of light emission slightly deviates only in the vicinity of the temporal position of the subfield SF3. However, at a gradation value of "32" of the input image signal S2, the temporal center of gravity of light emission is located in the subfield SF6, and compared with the gradation values from 27 to 31, the temporal center of gravity of light emission deviates greatly. In such a case, the dynamic false contour tends to occur. Hence, to prevent the dynamic false contour from occurring, the subfield lighting pattern of the gradation value of "32" is not used. The unused specific subfield lighting pattern is a pattern in which a temporal deviation of the temporal center of gravity of light emission with respect to a subfield lighting pattern with a luminance value adjacent thereto is larger than a mean value of temporal deviations of the temporal center of gravity of light emission between subfield lighting patterns with adjacent luminance values.

FIG. 11 is a table showing subfield lighting patterns which are usable for preventing the dynamic false contour from occurring, and compared with FIG. 9, the subfield lighting patterns of gradation values from 32 to 35 are deleted to make them unusable. By making the subfield lighting patterns of the gradation values from 32 to 35 unusable, the occurrence of the dynamic false contour can be reduced.

FIG. 12 is a graph showing the relation between the input image signal S2 and luminance in the subfield lighting patterns shown in FIG. 11. Since the subfield lighting patterns of the gradation values from 32 to 35 of the input image signal S2 cannot be used, the gradation values from 32 to 35 are expressed by an error diffusion using the subfield lighting patterns of the gradation values of 31 and 36 in the same manner as in the first embodiment. Consequently, the dynamic false contour can be reduced while the number of gradations is maintained.

As described above, in the subfield lighting patterns in FIG. 9, the change in the temporal center of gravity of light emission between the gradation values 31 and 32 is large, so that the dynamic false contour occurs. Therefore, the subfield lighting pattern of such gradation value cannot be used. Moreover, for the above-described reason, the conventional plasma display device has a problem that the luminance weight of a heavy subfield cannot be sufficiently enlarged with respect to a subfield having a luminance weight smaller by one. With respect to such arrangement of subfields having luminance weights, the nonlinear gain circuit 102 of this embodiment reduces the dynamic false contour while maintaining the number of gradations by lighting up the gradation values of 32, 33, 34, and 35 by allocating the subfield lighting patterns of the gradation values of 31 and 36 in a ratio whose sum is 1.

In order to reduce the dynamic false contour, without using one subfield lighting pattern (of the gradation value of 32) out of a combination of subfield lighting patterns between which the temporal center of gravity of light emission changes greatly, an error diffusion is performed between the other subfield lighting pattern (of the gradation value of 31) and another subfield lighting pattern (of the gradation value of 36) which is apart therefrom by 2 or more, thereby expressing a gradation of the unused subfield pattern in a false manner.

This makes it possible to use a combination of weights of subfields which cannot be conventionally used because the dynamic false contour tends to occur, and as a result, the number of gradations can be increased. For example, by letting weights of respective subfields (SF6, SF5, SF4, SF3, SF2, SF1)=(32, 16, 8, 4, 2, 1) when the number of subfields is 6, the number of gradations is 64 gradations, but between the lighting pattern (0, 1, 1, 1, 1, 1) expressing the gradation value of 31 and the lighting pattern (1, 0, 0, 0, 0, 0) expressing the gradation value of 32, the dynamic false contour occurs strongly. Namely, the lighting pattern (1, 0, 0, 0, 0, 0) such that the subfield SF6 with the maximum weight lights up alone cannot be used. To reduce the dynamic false contour, a method of always lighting up another subfield when the subfield SF6 with the maximum weight lights up is conceivable. However, in this case, the usable subfield lighting patterns are limited, resulting in a reduction in the number of gradations. For example, in the case of weights of respective subfields (SF6, SF5, SF4, SF3, SF2, SF1)=(24, 16, 8, 4, 2, 1), a gradation value of 32 is expressed by the lighting pattern (1, 0, 1, 0, 0, 0). The nonlinear gain circuit 102 of this embodiment expresses the gradation value of 32 by letting the weights of the respective subfields remain (SF6, SF5, SF4, SF3, SF2, SF1)=(32, 16, 8, 4, 2, 1), and instead of using the subfield lighting pattern (1, 0, 0, 0, 0, 0), using a combination of the subfield lighting pattern (1, 0, 0, 1, 0, 0) expressing the gradation value of 36 and the subfield lighting pattern (0, 1, 1, 1, 1, 1) expressing the gradation value of 31 in a ratio whose sum is 1. In this case, the dynamic false contour is reduced, and the number of gradations is increased.

In this embodiment, a larger number of gradation values are expressed by diffusion processing on the higher gradation value side, and no or a smaller number of gradation values are expressed by diffusion processing on the lower gradation value side. The purpose of expressing a larger number of gradation values by diffusion processing on the higher gradation value side is to reduce the dynamic false contour. The purpose of expressing no or a smaller number of gradation values by diffusion processing on the lower gradation value side is to display the low gradation value part by high-density lighting pixels. To reduce the dynamic false contour at all of the gradation values, gradation values at which diffusion processing is performed are allowed even on the low gradation value side. Namely, in a region where the gradation value of the image signal S2 is larger than the intermediate value of all of the gradation values, the number of gradation values at which the image signal S2 is converted to the image signal S3 whose decimal part (error part) SB is not zero is larger than in a region where the gradation value of the image signal S2 is smaller than the intermediate value of all of the gradation values.

Third Embodiment

Figure 18:
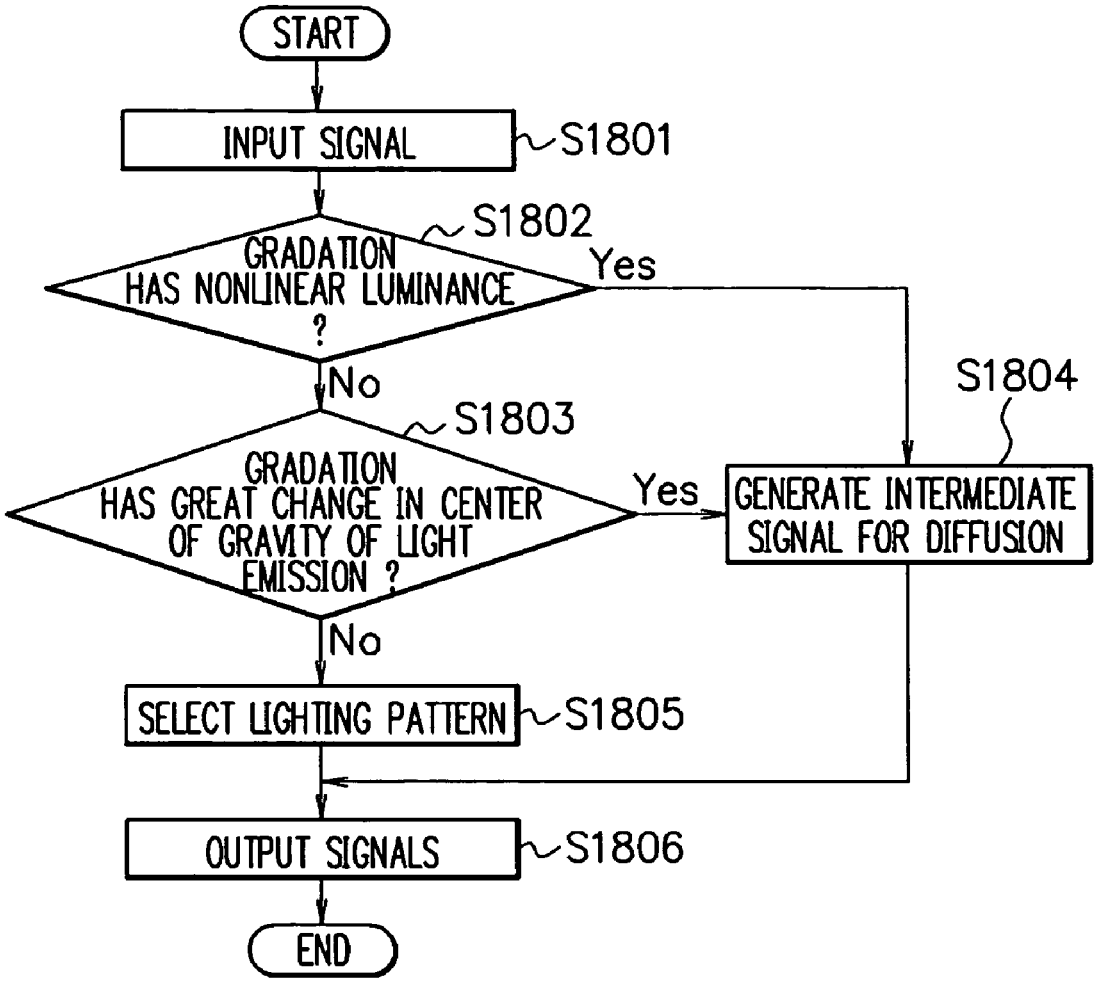
FIG. 18 is a flowchart showing a processing example of a plasma display device according to a third embodiment of the present invention.

FIG. 18 is a flowchart showing a processing example of a plasma display device according to a third embodiment of the present invention. This embodiment is realized by combining the first and second embodiments. First, in step S1801, an image signal is inputted. Then, in step S1802, it is determined whether or not the gradation has nonlinear luminance as in the first embodiment. If the gradation has nonlinear luminance, the procedure goes to step S1804, and if not, the procedure goes to step S1803. In step S1803, it is determined whether or not the gradation has a great change in the temporal center of gravity of light emission as in the second embodiment. If the gradation has a great change in the temporal center of gravity of light emission as in the second embodiment, the procedure goes to step S1804, and if not, the procedure goes to step S1805. In step S1805, a subfield lighting pattern according to the input image signal is selected since all subfield lighting patterns are usable, and the procedure goes to step S1806. In step S 1804, as in the first and second embodiments, the nonlinear gain circuit 102 generates an intermediate image signal S3 to diffuse an error, the subfield conversion circuit 104 selects a subfield lighting pattern corresponding thereto, and the procedure goes to step S1806. In step S1806, signals are outputted to the address control circuit 121, the X electrode control circuit 122, and the Y electrode control circuit 123.

Fourth Embodiment

FIG. 15 is a diagram showing a configuration example of a plasma display device according to a fourth embodiment of the present invention, and differs from FIG. 1 in that a display load factor T3 is supplied to the nonlinear gain circuit 102. Points of this embodiment different from the first embodiment will be described below.

The sustain pulse number setting circuit 106 receives the display load factor T2 for every subfield and outputs the display load factor T3 for every field. The nonlinear gain circuit 102 selects any one of plural kinds of nonlinear conversions from the image signal S2 to the image signal S3 according to the display load factor T3, and outputs the image signal S3.

Figure 16:
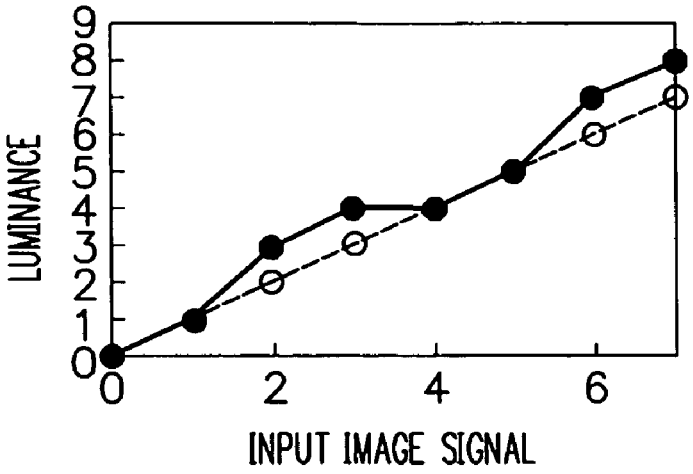
FIG. 16 is a graph showing the relation between the input image signal and luminance.

In this embodiment, the number of sustain pulses is changed according to the display load factor by the above-described constant power control. The sustain pulse number setting circuit 106 allocates the total number of sustain pulses among respective subfields in an integer ratio almost equal to luminance weights of the respective subfields, but depending on the value of the total number of sustain pulses, there is a possibility that the integer ratio almost equal to luminance weights of the respective subfields cannot be achieved. For example, a case where when the number of subfields is six, the luminance weights are (SF6, SF5, SF4, SF3, SF2, SF1)=(32, 16, 8, 4, 2, 1), and the total number of sustain pulses at a low load is 252, the total number of sustain pulses becomes 220 by constant power control will be described. In this case, if it is defined that decimals are rounded off, the numbers of sustain pulses in the respective subfields become SF6=32/252×220=28, SF5=16/252×220=14, SF4=8/252×220=7, SF3=4/252×220=3, SF2=2/252×220=2, and SF1=1/252×220=1. The luminance ratio of the subfield SF3 changes from 4 to 3, and thus the gradation linearity is broken. In particular, nonlinearity of gradation is conspicuous in the low gradation region. To avoid this, in the same manner as in the first embodiment, the use of subfield lighting patterns of gradation values of 2 and 3 which provide nonlinearity as in FIG. 16 is avoided, and the gradation values of 2 and 3 are expressed by allocating the subfields lighting patterns of gradation values of 1 and 4 in a ratio whose sum is 1. In FIG. 16, a solid line represented by black circles shows luminance in low gradation when the total number of sustain pulses is 220 as described above, and a broken line represented by white circles shows the luminance of the output image signal S3 after conversion in the nonlinear gain circuit 102.

Figure 17:
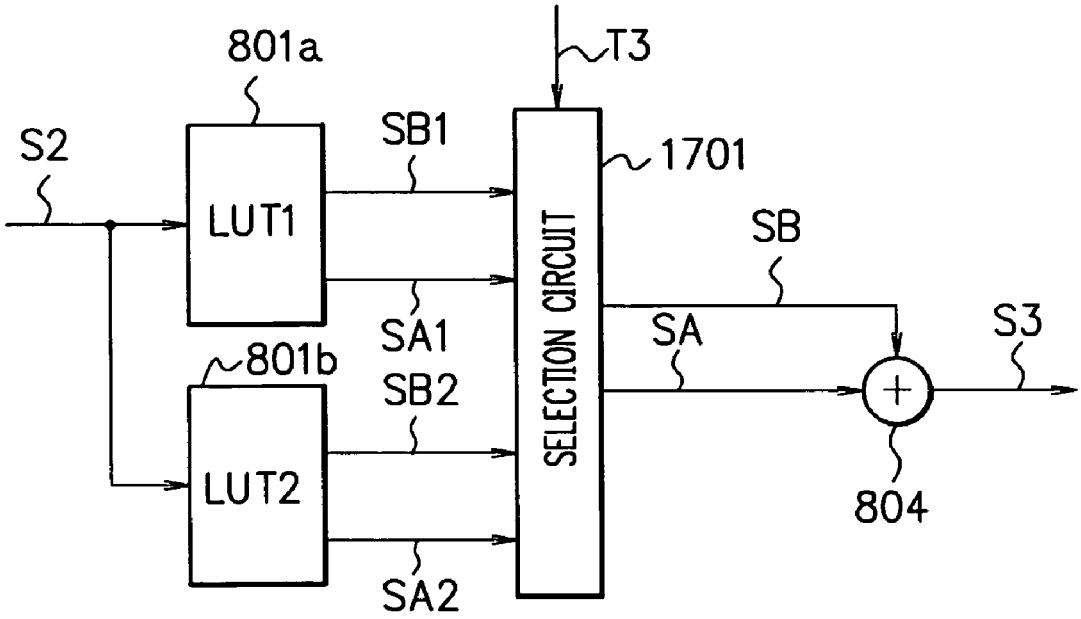
FIG. 17 is a diagram showing a configuration example of the nonlinear gain circuit in FIG. 15.

FIG. 17 is a diagram showing a configuration example of the nonlinear gain circuit 102 in FIG. 15, and points different from FIG. 8 will be described below. Two lookup tables 801*a* and 801*b* correspond to the lookup table 801 in FIG. 8. A selection circuit 1701 is newly added.

The lookup table 801*a* is a table to perform a nonlinear conversion when the display load factor T3 is smaller than a threshold value and outputs an integral part SA1 and a decimal part SB1. The lookup table 801*b* is a table to perform a nonlinear conversion when the display load factor T3 is equal to or more than the threshold value and outputs an integral part SA2 and a decimal part SB2.

The selection circuit 1701 receives the display load factor T3, and when the display load factor T3 is smaller than the threshold value, it selects the integral part SA1 and the decimal part SB1 and outputs them as the integral part SA and the decimal part SB. When the display load factor T3 is equal to or more than the threshold value, it selects the integral part SA2 and the decimal part SB2 and outputs them as the integral part SA and the decimal part SB. The adder 804 performs the same processing as in FIG. 8.

The nonlinear gain circuit 102 includes plural lookup tables 801*a* and 801*b* and selects the lookup table 801*a* or 801*b* according to the display load factor T3. Namely, the nonlinear gain circuit 102 selects any one of plural kinds of nonlinear conversion tables 801*a* and 801*b* from the image signal S2 to the image signal S3 according to the display load factor T3 and outputs the image signal S3. This makes it possible to perform the nonlinear conversion according to the display load factor T3 and maintain gradation linearity.

As described above, according to the first to fourth embodiments, if the specific subfield lighting pattern is used, the linear characteristic of gradation may be destroyed and the dynamic false contour may occur. By avoiding use of the specific subfield lighting pattern, the linear characteristic of the gradation can be maintained and the occurrence of the dynamic false contour can be reduced. Furthermore, even if the specific subfield lighting pattern cannot be used, the number of gradations is not reduced thanks to the error diffusion processing using other subfield lighting patterns, leading to the realization of high image quality.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

If a specific subfield lighting pattern is used, the linear characteristic of gradation may be destroyed and a dynamic false contour may occur. By avoiding use of the specific subfield lighting pattern, the linear characteristic of the gradation can be maintained and the occurrence of the dynamic false contour can be reduced. Furthermore, even if the specific subfield lighting pattern cannot be used, the number of gradations is not reduced thanks to error diffusion processing using other subfield lighting patterns, leading to the realization of high image quality.

What is claimed is:

1. A plasma display device, comprising:

a display unit which expresses a gradation of an image by selecting a pattern of subfields to light up out of plural subfields composing one field, each of the subfields having a weighted number of sustain pulses;

a nonlinear conversion circuit which nonlinearly converts first image data corresponding to an input image signal to second image data having a gradation value smaller than a gradation value of the first image data and expresses the second image data by a real part and an error part;

an error diffusion circuit which, when the error part of the second image data is not zero, spatially or temporally diffuses the error part; and a subfield pattern conversion circuit which selects the lighting pattern of subfields based on the error-diffused second image data, wherein the second image data does not have predetermined subfield lighting pattern image data, and wherein said nonlinear conversion circuit outputs, in place of the predetermined subfield lighting pattern image data, interpolated data calculated by interpolation using plural subfield lighting pattern image data patterns adjacent to the predetermined subfield lighting pattern in the second image data.

2. The plasma display device according to claim 1, wherein said nonlinear conversion circuit has a table to convert the first image data signal to the second image data.

3. The plasma display device according to claim 1, wherein said nonlinear conversion circuit selects any one of plural kinds of nonlinear conversions from the first image data to the second image data and outputs the second image data.

4. A plasma display device comprising: a display unit which expresses a gradation of an image by selecting a pattern of subfields to light up out of plural subfields composing one field, each of the subfields having a weighted number of sustain pulses;

a nonlinear conversion circuit which nonlinearly converts first image data corresponding to an input image signal to second image data having a gradation value smaller than a gradation value of the first image data and expresses the second image data by a real part and an error part;

an error diffusion circuit which, when the error part of the second image data is not zero, spatially or temporally diffuses the error part; and a subfield pattern conversion circuit which selects the lighting pattern of subfields based on the error-diffused second image data, wherein when a gradation value of the second image data corresponding to the gradation value of the first image data does not exist, said nonlinear conversion circuit outputs, in place of the gradation value, interpolated data calculated by interpolation using plural gradation values existing in the second image data.

5. A processing method of a plasma display device which expresses a gradation of an image by selecting a pattern of subfields to light up out of plural subfields composing one field, each of the subfields having a weighted number of sustain pulses, comprising:

a nonlinear conversion operation of nonlinearly converting first image data corresponding to an input image signal to second image data having a graduation value smaller than a graduation value of the first image data and expressing the second image data by a real part and an error part;

an error diffusion operation of, when the error part of the second image data is not zero, spatially or temporally diffusing the error part; and a subfield pattern conversion operation of selecting the lighting pattern of subfields based on the error-diffused second image data, wherein the second image data does not have predetermined subfield lighting pattern image data, and wherein said nonlinear conversion operation outputs, in place of the predetermined subfield lighting patterns image data, interpolated data calculated by interpolation using plural subfield lighting pattern image data patterns adjacent to the predetermined subfield lighting pattern in the second image data.

6. The processing method of the plasma display device according to claim 5, wherein in said nonlinear conversion operation, the first image data is converted to the second image data using a table.

7. The processing method of the plasma display device according to claim 5, wherein in said nonlinear conversion operation, any one of plural kinds of nonlinear conversions from the first image data signal to the second image data is selected and the second image data signal is outputted.

8. A processing method of a plasma display device which expresses a gradation of an image by selecting a pattern of subfields to light up out of plural subfields composing one field, each of the subfields having a weighted number of sustain pulses, comprising:

a nonlinear conversion operation of nonlinearly converting first image data corresponding to an input image signal to second image data having a gradation value smaller than a gradation value of the first image data and expressing the second image data by a real part and an error part;

an error diffusion operation of, when the error part of the second image data is not zero, spatially or temporally diffusing the error part; and a subfield pattern conversion operation of selecting the lighting pattern of subfields based on the error-diffused second image data, wherein when a gradation value of the second image data corresponding to the gradation value of the first image data does not exist, in said non linear conversion operation, in place of the gradation value, interpolated data, which is calculated by interpolation using plural gradation values existing in the second image data is outputted.

9. A display device, comprising: a first circuit capable of nonlinearly converting first image data to second image data having a smaller gradation value and a real part and an error part;

a second circuit which selects a lighting pattern of subfields based on second image data that is error-diffused;

wherein the second image data not having predetermined subfield lighting pattern image data, and the first circuit outputs interpolated data calculated by interpolation by using plural subfield lighting data patterns adjacent to the predetermined subfield lighting pattern.

* * * * *